United States Patent [19]

Burgess et al.

[11] Patent Number: 4,921,034

[45] Date of Patent: May 1, 1990

[54] EMBOSSED PAPER HAVING ALTERNATING HIGH AND LOW STRAIN REGIONS

[75] Inventors: William H. Burgess, Wallingford, Pa.; Kenneth Kaufman, Mt. Laurel, N.J.; Archie B. Lane, Jr., Wallingford, Pa.

[73] Assignee: Scott Paper Company, Philadelphia, Pa.

[21] Appl. No.: 185,171

[22] Filed: Apr. 22, 1988

[51] Int. Cl.[5] ..... D21H 5/02

[52] U.S. Cl. ..... 162/109; 162/113; 162/117; 162/118; 428/153; 428/171; 428/174; 428/179

[58] Field of Search ..... 162/113, 117, 362, 109, 162/118; 428/153, 154, 171, 174, 179

[56] References Cited

U.S. PATENT DOCUMENTS

| | | | |
|---|---|---|---|
| 3,817,827 | 6/1974 | Benz | 162/113 |
| 4,671,983 | 6/1987 | Burt | 428/179 |
| 4,759,967 | 7/1988 | Bauernfeind | 428/154 |

FOREIGN PATENT DOCUMENTS

| | | | |
|---|---|---|---|
| 0162704 | 11/1985 | European Pat. Off. | 428/179 |

*Primary Examiner*—Peter Chin

*Attorney, Agent, or Firm*—R. Duke Vickrey; J. W. Kane, Jr.

[57] ABSTRACT

An embossed sanitary paper product and method of making such product. The paper is embossed to form in the paper a midplane and an array of bosses extending up and down from the formed midplane. Each upward extending boss is flanked on two sides, in each of two directions, by a downward extending boss, and in at least one of the two directions, the paper between an upward extending boss tip and an adjacent downward extending boss tip on one side has a higher strain than the paper between the upward extending boss tip and an adjacent downward extending boss tip on the opposite side. The forming of a higher strain region and a lower strain region on opposite sides of a boss can be accomplished by forming asymmetric bosses with each upward extending boss rotated 180° about an axis perpendicular to the plane of the paper with respect to its adjacent downward extending bosses.

19 Claims, 2 Drawing Sheets

EMBOSSED PAPER HAVING ALTERNATING HIGH AND LOW STRAIN REGIONS

TECHNICAL FIELD

This invention relates to the embossing of base sheet paper during the manufacture of sanitary paper products such as toilet tissue, paper napkins, paper towels and paper wipers. More particularly, this invention is directed to embossing a paper web to form bosses in the paper that will resist compressive forces such as those generated when the paper is wound into a roll, while at the same time preserving cross-machine direction tensile strength.

BACKGROUND

Embossing has long been used as a method to treat base paper for sanitary paper products to make those paper products more absorbent, softer and bulkier than the unembossed paper. The prior art discloses three methods of embossing paper between a pair of patterned embossing rolls. In the first method, one embossing roll has only male projections and the other embossing roll has only female recesses. This type of male-female embossing rolls is disclosed in U.S. Pat. No. 4,339,088-Niedermeyer at column 2, lines 25–37. The Niedermeyer patent is also relevant to a preferred embodiment of this invention because of its disclosure that by employing a pattern repeat in the machine direction that is equal to or greater than the circumference of the finished roll of paper, nesting and breakdown of the embossments in the roll can be retarded. in a second embossing method, both embossing rolls have only male projections. Such male-to-male embossing rolls are disclosed in U.S. Pat. No. Re. 27,453-Schutte, et al. and U.S. Pat. No. 3,817,827-Benz, both patents being assigned to the assignee of this application. In a third embossing method, both rolls have male projections and female recesses. During embossing the male projections of one roll extend into mating female recesses of the other roll and the male projections of the other roll extend into mating female recesses of the one roll. This type of embossing is described in UK Patent Application GB No. 2132141A-Bauernfeind. In both rolls of Bauernfeind, a neutral plane completely surrounds each male projection and female recess. Bauernfeind also discloses at page 1, lines 86–90 that the embossing elements can have both regular and unsymmetrical shapes and that if the element has both a major axis and a minor axis, aligning the major axis in the cross-machine direction will result in less cross-machine direction tensile degradation than if the element is oriented with the major axis aligned in the machine direction.

It is an object of this invention to provide an improved method of forming bosses in sanitary paper product.

Another object of this invention is to provide an embossed paper that for a given base sheet paper, and at a given product cross-machine direction tensile level, has improved resistance to compressive force normal to the plane of the paper.

It is another object of this invention to provide an embossed sanitary paper product that better resists compressive forces when it is wound onto a core to form a rolled sanitary paper product.

And yet another object of this invention is to provide improved embossing rolls of the type in which both rolls have male projections, female recesses and a midplane.

SUMMARY OF THE INVENTION

In accordance with this invention, base paper having a basis weight between 7 and 60 pounds per 2,880 square feet and a crossmachine direction tensile between 3 and 100 ounces per inch is embossed to form in the paper a midplane and an array of bosses extending up and down from the formed midplane. Each upward extending boss is flanked on two sides, in each of two directions, by a downward extending boss, and in at least one of the two directions, the paper between an upward extending boss tip and an adjacent downward extending boss tip on one side has a higher strain than the paper between the upward extending boss tip and and adjacent downward extending boss tip on the opposite side.

In one aspect of this invention, the upward extending bosses and the downward extending bosses have the same asymmetric shape and each upward extending boss is rotated 180° about an axis perpendicular to the plane of the paper with respect to its adjacent downward extending bosses.

In another aspect of the invention, at the midplane of the embossed paper, a rectangle circumscribing each boss is tangent to all four sides of the boss and the sides of each rectangle are colinear with sides of adjacent rectangles which tends to maximize the boss sidewall perimeter for a given area of the paper.

In a preferred embodiment of the invention, the cross-section of each boss has a generally rounded trapezoidal shape with the parallel sides generally aligned with the cross-machine direction of the paper and each boss is longer in the cross-machine direction than in the machine direction.

The method of the invention comprises the steps of (a) providing base sheet paper having a basis weight between 7 and 60 pounds per 2,880 square feet and a cross-machine direction tensile of between 3 and 100 ounces per inch; (b) forming a midplane in the paper and a plurality of bosses extending up and down from the midplane, each upward extending boss being flanked on two sides in each of two directions by a downward extending boss, and in at least one of said directions, the paper between and upward extending boss tip and an adjacent downward extending boss tip on one side has a high strain than the paper between the upward extending boss tip and an adjacent downward extending boss tip on the opposite side; and (c) winding the web onto a core.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
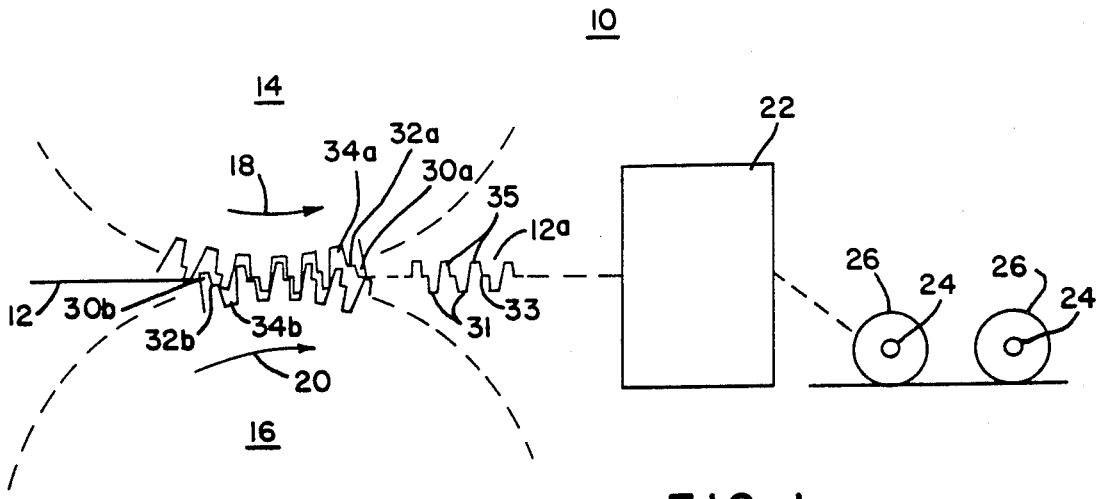
FIG. 1 is a schematic diagram illustrating apparatus for embossing and winding the embossed paper into rolls.

FIG. 1 is a schematic diagram of a portion of a typical system 10 for converting base sheet paper 12 into rolls 26 of paper product. In FIG. 1, the base sheet paper 12 is being provided to a nip formed by a pair of embossing rolls 14, 16 rotating in the direction as indicated by arrows 18 and 20 respectively. The embossed paper 12*a* is then directed to a rewinder 22 which winds the embossed paper 12*a* onto cores 24 to form long rolls, or logs 26 of the rolled paper product. The logs 26 are then conveyed to a log saw (not shown) where they are cut into the smaller lengths as sold to a consumer.

The base sheet paper 12 entering the embossing rolls 14, 16 typically has a basis weight (BW) in the range of 7 to about 60 pounds per ream of 2,880 square feet and has a cross-machine direction tensile (CDT) of between 3 and about 100 ounces per inch.

Both embossing rolls 14, 15 have a plurality of male projections 30*a*, 30*b*, female recesses 34a, 34b and a midplane region 32*a*, 32*b*. When the embossed paper 12*a* emerges from the nip of the embossing rolls 14, 16, it will have a midplane region 33 and a plurality of bosses 35 extending upward from the midplane 33 and a plurality of bosses 31 extending downward from the midplane 33. The upward extending bosses 35 will generally have the same cross-sectional shape as the male projections 30*b* that formed the bosses 35 and, in a similar manner, downward extending bosses 31 will generally have the same cross-sectional shape as the male projections 30*a* that formed the bosses 31.

Figure 2:
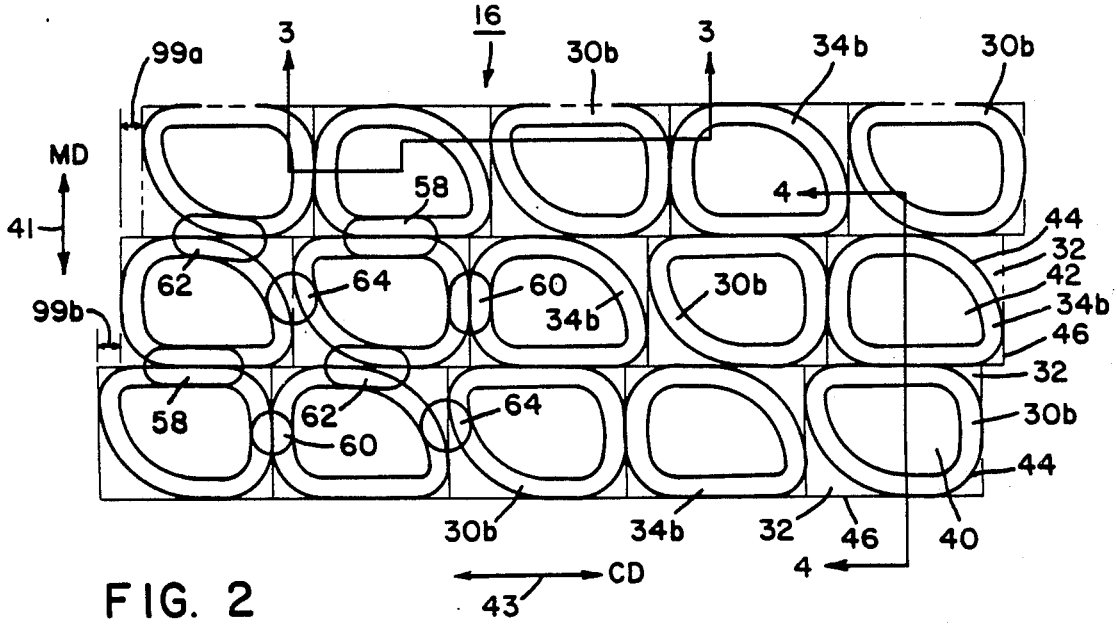
FIG. 2 is a modified plan view looking at a portion of the surface of the lower embossing roll illustrated in FIG. 1.

FIGS. 2–5 show in detail a preferred embodiment of embossing rolls 14, 16. FIG. 2 is a modified plan view of a typical embossing roll 14, 16 such as lower embossing roll 16 of FIG. 1. FIG. 2 is modified in that the embossing elements 30*b*, 34*b* are depicted as if they extend up from or project down from a plane rather than from the curved surface of the roll 16; and, as shown at the lower right hand corner of FIG. 2, in addition to showing the tips 40 of male projections 30*b* and the floors 42 of the female recesses 34*b*, FIG. 2 shows the intersection 44 of each male projection 30*b* and female recesses 34*b* with the midplane 32 as well as a rectangle 46 circumscribing each intersection 44. The machine direction of the embossing roll 16 is indicated by the line 41 with the arrowheads labeled "MD" and the cross-machine direction of the embossing roll 16 is indicated by the line 43 with the arrowheads labeled "CD". In FIG. 2, the embossing elements 30*b*, 34*b* are aligned with the cross-machine direction of the roll 16 but are aligned at a slight angle to the machine direction of the roll 16 as will be explained later in this description. Each male projection 30*b* is flanked on each side in both the machine direction and the cross-machine direction by a female recess 34*b*.

Figure 5:
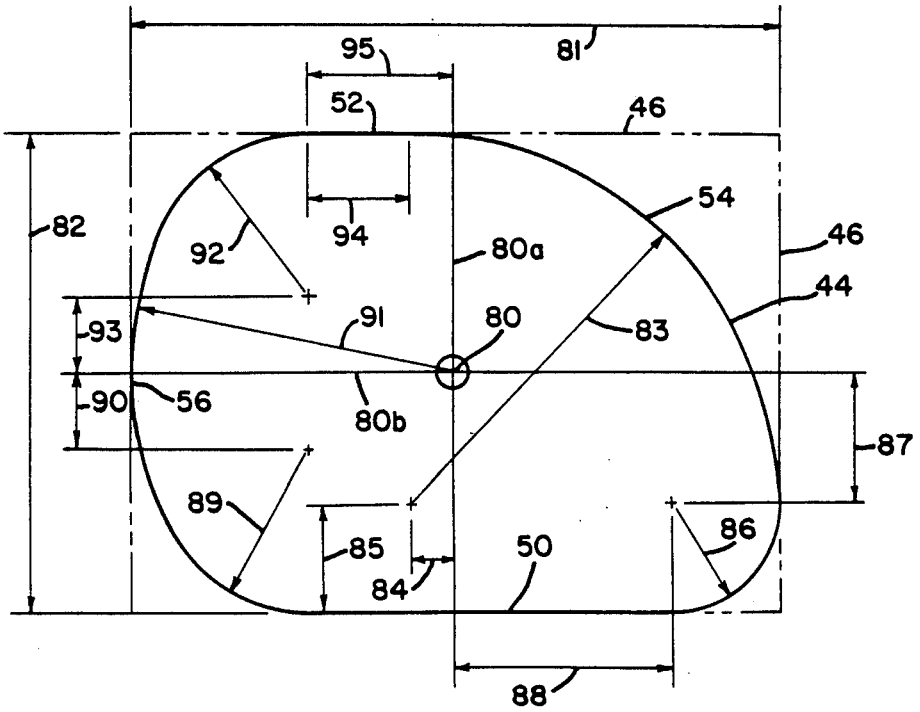
FIG. 5 is a cross-sectional view of a typical embossing element at the midplane.

As best shown in FIG. 5, the cross-sectional shape of each male projection 30*b* and female recess 34 can be considered to be generally trapezoidal because it has a long parallel side 50 and a short parallel side 52 with the parallel sides aligned with the cross-machine direction of the roll 16. The nonparallel sides 54, 56 of the cross section have been curved and all sharp corners of the trapezoid have been rounded. The generally trapezoidal shape is asymmetric in that there is no axis about which it is symmetrical.

Referring back to FIG. 2, in the preferred embodiment, the male projections 30*a* and 30*b* on rolls 16, 18 have the same shape so that the embossed paper 12*a* has the same appearance on both sides of the paper and each male projection 30*b* is rotated 180° about an axis perpendicular to the surface of the roll 16 with respect to the male projection 30*a* of roll 14 which fits into female recess 34*b* of roll 16. The rectangle 46 that circumscribes the intersection 44 of each male projection 30*b* and female recess 34*b* with the midplane 32 is on each side colinear with its adjacent circumscribing rectangle 46 which tends to maximize the perimeter of the boss walls for a given area of the paper in order to increase the resistance to compressive forces on the surface of the embossed paper 12*a*.

One feature of this embossing pattern is that in both the machine direction and the cross-machine direction, the embossed paper between a male projection 30*b* and the adjacent female recess 34*b* is strained to a higher degree than the paper embossed between the same male projection 30*b* and the female recess 34*b* on the opposite side. Thus, as shown at the lower left hand portion of FIG. 2, the paper embossed in the regions 58, 60 will undergo a relatively high strain as compared to the paper embossed in the regions 62, 64 of roll 16. That the strain in region 58 is higher than in region 62 can be seen by referring to FIG. 4. Paper which had an original length 66 has been deformed to assume a length along sloped wall 70, while the paper having the original length 68 has been deformed to assume a length that is the sum of: (a) a length along sloped wall 72, (b) midplane length 73, and (c) sloped wall length 74. Since the length along sloped wall 72 added to the length of slope wall 74 is just about equal to the length along sloped wall 70, and since the entire length 68 of paper undergoes stretching or deformation before it is positioned along the surfaces 72, 73 and 74, the strain in the paper along sloped wall 70 is higher than along walls 72, 73 and 74. Although regions 58 and 60 have been called high strain regions it is preferred that the paper is not strained in those regions to the extent that they have tears or perforations. Preventing or minimizing the tears and perforations in the highly strained sloping walls increases their resistance to compressive force applied to the embossed paper 12*a*.

Figure 3:
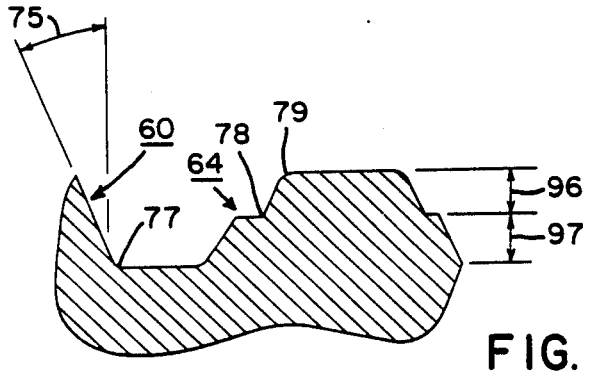
FIG. 3 is a sectional view taken along the line 3—3 of FIG. 2.
Figure 4:
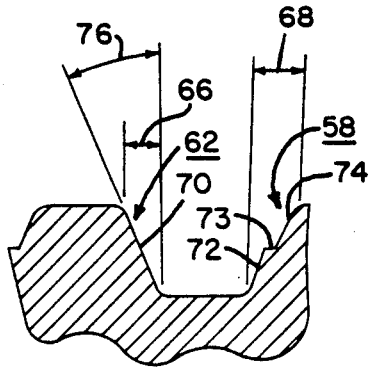
FIG. 4 is a sectional view taken along the line 4—4 of FIG. 2.

Also, as shown in FIGS. 3 and 4, in the preferred embodiment, the high strain regions 58 and 60 of the paper do not have a midplane 32; however, it will be apparent to one skilled in the art that a midplane 32 could be formed in the high strain region 58 and 60, and by controlling the relative width of the midplane 32 in the high strain regions 58 and 60 with respect to the width of the midplane 32 in the low strain regions 62 and 64, a relatively high strain region and a relatively low strain region can be formed in the paper on opposite sides of male projection 30*b*. The preferred embodiment is one in which there is no midplane 32 in the high strain regions 58, 60 because this tends to maximize the perimeter of the sloped walls which resist compressive forces on the surface of the paper 12*a*. The formation of a midplane 32 surrounding much of each embossing element is also believed to help increase the resistance of the paper 12*a* to compressive forces over male-female and male-male embossing as described in the aforementioned patents to Niedermeyer, Schutte, et al. and Benz, because for the same thickness (as measured from one embossed surface to the other embossed surface) the midplane region 32 is believed to provide considerable support to sloping walls 72 and 74 so that they tend to function as two columns over a portion of the periphery, each column having one-half the length of a corresponding column formed during male-female embossing. Because of this shorter column length, the bosses formed up and down from the midplane 32 will tend to resist compressive forces more effectively than bosses formed entirely of the longer columns.

The detailed construction of a typical male projection **30*b* is shown in FIG. 5 and Table I. FIG. 5 is an enlarged depiction of the intersection 44 of a typical embossing element 30, 34 with the midplane surface 32 and the rectangle 46 that circumscribes the intersection 44. The point 80 is at the intersection of vertical centerline 80*a* and horizontal centerline 80*b*. The length, location, and radius of all elements depicted in FIG. 5 are given in Table I below. The angle that the side walls of the male projection 30*b* and female recesses 34*b* make with the vertical as represented by element 75 in FIG. 3 and element 76 in FIG. 4 is 22 degrees. Also, as shown in FIG. 3, the corners 77 at the floor of a female recess 34*b* has a 0.010 inch radius, the corners 78 at midplane 32 has a radius of 0.002 inch and the edge 79 of a male projection 30*b* has a radius of 0.010 inch. The height 96 of a male projection 30*b* is 0.030 inches above the midplane surface 32 and the depth 97 of a female recess 34*b* below the midplane surface is 0.035 inch. Referring again to FIG. 2, the embossing elements 30*b*, 34*b* are aligned with the cross-machine direction of roll 16 but are offset a distance 99*a*, 99*b* in the cross-machine direction. The distance 99*a*, 99*b* varies from row to row, so that the repeat pattern in the machine direction has a length that approaches but is less than the circumference of a completely wound roll 26**.

TABLE I

| Element | Length (Inches) |
|---|---|
| 81 | 0.120 |
| 82 | 0.088 |
| 83 | 0.068 |
| 84 | 0.008 |
| 85 | 0.020 |
| 86 | 0.020 |
| 87 | 0.024 |
| 88 | 0.040 |
| 89 | 0.030 |
| 90 | 0.014 |
| 91 | 0.060 |
| 92 | 0.030 |
| 93 | 0.014 |
| 94 | 0.019 |
| 95 | 0.027 |

When base sheet paper having a basis weight of 7 to about 60 pounds per 2,880 square feet and cross-machine direction tensile of between 3 and 100 ounces per inch are embossed in accordance with this invention, the embossed paper will have a basis weight between about 6 to 58 pounds per 2,880 square feet and a cross-machine direction tensile between about 2 to 40 ounces per inch.

Table II below shows a comparison, for three different types of base sheet paper, of a typical male-male embossing as described in the Benz reference with embossing using rolls 14, 16 as specified in Table I and the preceding paragraph. In Table II, penetration is the extension of one roll into the other as measured from the tip of a male projection **30*b* on one roll 16 to the tip of a male projection 30*a* from the other roll 14 when the male projection 30*a* is in complete embossing engagement with its mating female recess 34*b***. Table II shows that for all three examples, when the paper is embossed to reduce the cross-machine direction tensile to about 16 ounces per inch, the paper embossed in accordance with this invention will form a larger diameter rolled product than paper embossed with the male-male rolls.

TABLE II

| | Base Paper | | Penetration | Embossed Paper | |
|---|---|---|---|---|---|
| | CDT (oz/in) | BW (lb/2880 ft$^2$) | (in) | CDT (oz/in) | Roll Diameter (in) |
| | | Example I | | | |
| Male-Male | 76.7 | 32.5 | 0.050 | 16.4 | 7.40 |
| Invention | 84.2 | 32.6 | 0.055 | 16.0 | 9.40 |
| | | Example II | | | |
| Male-Male | 46.2 | 25.2 | 0.035 | 15.6 | 6.20 |
| Invention | 45.8 | 26.4 | 0.048 | 16.6 | 7.45 |
| | | Example III | | | |
| Male-Male | 43.1 | 23.5 | 0.035 | 15.4 | 6.35 |
| Invention | 42.5 | 20.8 | 0.045 | 16.6 | 6.94 |

While the present invention has been described with respect to a specific embodiment thereof, it would be obvious to those skilled in the art that various changes and modifications may be made without departing from the invention in its broader aspects.

We claim:

1. A soft, embossed, sanitary paper product useful for tissues, towels, napkins and wipers, comprising a paper web having a basis weight between about 6 and about 58 pounds per 2,880 square feet, a tensile strength in the cross-machine direction between 2 and 40 ounces per inch of width, and a plurality of bosses of the same size and shape alternating up and down from a formed midplane across the plane of the web in two directions;

the paper product being characterized by:

A. each boss having an asymmetric shape in a cross section parallel to the midplane;

B. said asymmetric shape in the up bosses having a different orientation from that of the down bosses; and C. on each boss, the paper interconnecting it with the adjacent boss on one side being strained more than the paper interconnecting said each boss with the adjacent boss on its opposite side.

2. The paper product of claim 1, wherein property C. occurs in two directions across the plane of the web.

3. The paper product of claim 1, wherein the bosses have been formed by molding the paper between male embossment projections and mating female recesses.

4. The paper product of claim 1, wherein the embossed web has no perforations.

5. The embossed sanitary paper product of claim 2 wherein said two directions are orthogonal.

6. The embossed paper product of claim 1 wherein, at the mid-plane, a rectangle circumscribing each boss tangent to all four sides of the boss and wherein the sides of each rectangle are colinear with the sides of adjacent rectangles thereby tending to maximize the boss sidewall perimeter for a given area of the paper.

7. The paper product of claim 1 in combination with a core, the embossed paper being wound around the core to form a roll of sanitary paper product.

8. The embossed sanitary paper product of claim 1 wherein each upward extending boss is rotated 180° about an axis perpendicular to the plane of the paper with respect to its adjacent downward extending bosses.

9. The embossed sanitary paper product of claim 5 wherein said orthogonal directions are the machine direction and the cross-machine direction of the paper.

10. The embossed sanitary paper product of claim 9 wherein the cross-section of each boss is longer in the cross-machine direction than in the machine direction of the paper.

11. The embossed sanitary paper product of claim 8 wherein the paper has a machine direction and cross-machine direction and wherein each boss has a generally trapezoidal cross-section with the parallel sides generally aligned with the cross-machine direction of the paper.

12. The embossed sanitary paper product of claim 11 wherein the cross-section of each boss is longer in the cross-machine direction than the machine direction of the paper.

13. The embossed paper product of claim 12, wherein, at the mid-plane, one nonparallel side of each upward extending boss is tangent to one nonparallel side of its adjacent downward extending boss and the other nonparallel side of each upward extending boss is spaced-apart from one nonparallel side of its adjacent downward extending boss whereby the paper has a higher strain region along the one nonparallel sides of adjacent bosses than along the other nonparallel sides of adjacent bosses.

14. The embossed paper product of claim 12 wherein, at the mid-plane, a major portion of the long parallel side of each upward extending boss is tangent to a major portion of the long parallel side of its adjacent downward extending boss and the short parallel side of each upward extending boss is spaced apart from the short parallel side of its adjacent downward extending boss whereby the paper has a higher strain region along the long parallel sides of adjacent bosses than along the short parallel sides of adjacent bosses.

15. The embossed paper product of claim 12 wherein, at the mid-plane, a rectangle circumscribing each boss is tangent to all four sides of the boss and wherein the sides of each rectangle are colinear with the sides of adjacent rectangles thereby tending to maximize the boss sidewall perimeter for a given area of the paper.

16. The embossed paper product of claim 13 wherein, at the mid-plane, a major portion of the long parallel side of each upward extending boss is tangent to a major portion of the long parallel side of its adjacent downward extending boss and the short parallel side of each upward extending boss is spaced apart from the short parallel side of its adjacent downward extending boss whereby the paper has a higher strain region along the long parallel sides of adjacent bosses than along the short parallel sides of adjacent bosses.

17. The embossed paper product of claim 16 wherein, at the mid-plane, a rectangle circumscribing each boss is tangent to all four side of the boss and wherein the sides of each rectangle are colinear with the sides of adjacent rectangles thereby tending to maximize the boss sidewall perimeter for a given area of the paper.

18. The paper product of claim 17 in combination with a core, the embossed paper being wound around the core to form a roll of sanitary paper product.

19. The embossed sanitary paper product of claim 18 wherein adjacent bosses in the machine direction of the paper are offset slightly in the cross-machine direction to provide a pattern repeat distance in the machine direction that approaches but is less than the circumference of the completely wound roll.

* * * * *